US007810430B2

(12) United States Patent
Chan et al.

(10) Patent No.: US 7,810,430 B2
(45) Date of Patent: Oct. 12, 2010

(54) WIRELESS DETONATOR ASSEMBLIES, CORRESPONDING BLASTING APPARATUSES, AND METHODS OF BLASTING

(75) Inventors: Sek Kwan Chan, Pierrefonds (CA); Ronald F. Stewart, Navan (CA); Howard A. Bampfield, Kelowna (CA)

(73) Assignee: Orica Explosives Technology Pty Ltd, Melbourne, Victoria (AU)

( * ) Notice: Subject to any disclaimer, the term of this patent is extended or adjusted under 35 U.S.C. 154(b) by 378 days.

(21) Appl. No.: 11/718,027

(22) PCT Filed: Nov. 2, 2005

(86) PCT No.: PCT/AU2005/001684

§ 371 (c)(1), (2), (4) Date: Jul. 29, 2008

(87) PCT Pub. No.: WO2006/047823

PCT Pub. Date: May 11, 2006

(65) Prior Publication Data

US 2008/0307993 A1 Dec. 18, 2008

Related U.S. Application Data

(60) Provisional application No. 60/623,941, filed on Nov. 2, 2004.

(51) Int. Cl.
*F42C 15/40* (2006.01)

(52) U.S. Cl. ..... 102/206; 102/207; 102/214; 102/301

(58) Field of Classification Search ..... 102/206, 102/301, 305, 308, 310, 311; 361/251, 256, 361/257; 320/108
See application file for complete search history.

(56) References Cited

U.S. PATENT DOCUMENTS

| | | | | |
|---|---|---|---|---|
| 4,065,709 | A * | 12/1977 | Sliwa et al. | 102/215 |
| 4,391,195 | A | 7/1983 | Shann | |
| 4,422,378 | A | 12/1983 | Plichta | |
| 4,422,379 | A | 12/1983 | Geller et al. | |
| 4,519,314 | A | 5/1985 | Jorgenson | |
| 4,525,873 | A | 6/1985 | Baues | |
| 4,576,093 | A | 3/1986 | Snyder | |
| 4,622,558 | A | 11/1986 | Corum | |

(Continued)

FOREIGN PATENT DOCUMENTS

| | | |
|---|---|---|
| CA | 1226044 | 8/1987 |

(Continued)

OTHER PUBLICATIONS

Grant, J. and Rauert, N., "Electronic Detonators—Australian trials", Explosives Engineering, Spring 1989, pp. 5-8.

(Continued)

*Primary Examiner*—Michael Carone
*Assistant Examiner*—Jonathan C Weber

(57) ABSTRACT

A wireless or partially wireless detonator assembly (10) and corresponding blasting apparatus, that may be "powered Up" by a remote source of power (13) that is entirely distinct from the energy used for general command signal communications (16). In one embodiment, the detonator assembly (10) may include an active power source (25) with sufficient power for communications, but insufficient power to cause intentional or inadvertent actuation of the detonator (10).

44 Claims, 5 Drawing Sheets

U.S. PATENT DOCUMENTS

| | | | | |
|---|---|---|---|---|
| 4,685,396 | A | 8/1987 | Birse et al. | |
| 4,762,067 | A * | 8/1988 | Barker et al. | 102/313 |
| 4,768,127 | A | 8/1988 | Desrochers | |
| 4,777,880 | A | 10/1988 | Beattie et al. | |
| 4,819,560 | A * | 4/1989 | Patz et al. | 102/202.5 |
| 4,860,653 | A | 8/1989 | Abouav | |
| 4,870,902 | A | 10/1989 | Simon et al. | |
| 4,870,903 | A | 10/1989 | Carel et al. | |
| 4,884,506 | A | 12/1989 | Guerreri | |
| 4,984,518 | A | 1/1991 | Yarrington | |
| 5,014,620 | A | 5/1991 | Leupacher | |
| 5,038,682 | A | 8/1991 | Marsden | |
| 5,101,727 | A | 4/1992 | Yarrington | |
| 5,146,044 | A | 9/1992 | Kurokawa et al. | |
| 5,148,748 | A | 9/1992 | Yarrington | |
| 5,159,149 | A | 10/1992 | Marsden | |
| 5,404,820 | A | 4/1995 | Hendrix | |
| 5,442,369 | A | 8/1995 | Van Voorhies et al. | |
| 5,654,723 | A | 8/1997 | Craven et al. | |
| 5,933,263 | A * | 8/1999 | Kinstler | 102/207 |
| 6,079,333 | A | 6/2000 | Manning | |
| 6,199,483 | B1 | 3/2001 | Barbiche | |
| 6,253,679 | B1 * | 7/2001 | Woodall et al. | 102/221 |
| 6,374,740 | B1 | 4/2002 | Moulard | |
| 6,386,108 | B1 * | 5/2002 | Brooks et al. | 102/217 |
| 6,422,145 | B1 | 7/2002 | Gavrilovic et al. | |
| 6,470,803 | B1 | 10/2002 | Liu et al. | |
| 6,557,636 | B2 | 5/2003 | Cernocky et al. | |
| 6,584,907 | B2 * | 7/2003 | Boucher et al. | 102/217 |
| 6,595,137 | B1 * | 7/2003 | Karlsson | 102/215 |
| 6,618,237 | B2 | 9/2003 | Eddy et al. | |
| 6,644,202 | B1 | 11/2003 | Duniam et al. | |
| 6,752,083 | B1 * | 6/2004 | Lerche et al. | 102/202.7 |
| 6,860,206 | B1 * | 3/2005 | Rudakevych et al. | 102/206 |
| 6,889,610 | B2 * | 5/2005 | Boucher et al. | 102/217 |
| 6,945,174 | B2 | 9/2005 | Aebi et al. | |
| 6,988,449 | B2 * | 1/2006 | Teowee et al. | 102/215 |
| 7,143,696 | B2 * | 12/2006 | Rudakevych et al. | 102/215 |
| 7,568,429 | B2 * | 8/2009 | Hummel et al. | 102/206 |
| 2002/0178955 | A1 | 12/2002 | Gavrilovic et al. | |
| 2003/0000411 | A1 | 1/2003 | Cernocky et al. | |
| 2003/0001753 | A1 | 1/2003 | Cernocky et al. | |
| 2003/0029344 | A1 * | 2/2003 | Eddy et al. | 102/200 |
| 2004/0031411 | A1 | 2/2004 | Novotney et al. | |
| 2005/0011389 | A1 * | 1/2005 | Teowee et al. | 102/200 |
| 2005/0015473 | A1 * | 1/2005 | Teowee et al. | 709/223 |
| 2006/0207461 | A1 * | 9/2006 | Koekemoer et al. | 102/206 |
| 2007/0044673 | A1 * | 3/2007 | Hummel et al. | 102/206 |
| 2008/0307993 | A1 * | 12/2008 | Chan et al. | 102/214 |
| 2009/0193993 | A1 * | 8/2009 | Hummel et al. | 102/215 |

FOREIGN PATENT DOCUMENTS

| | | | |
|---|---|---|---|
| CA | 2003166 | | 5/1991 |
| CA | 2031409 | | 6/1991 |
| CA | 1298899 | | 4/1992 |
| CA | 1307699 | | 9/1992 |
| CA | 1326068 | | 1/1994 |
| CA | 2037934 | | 11/1994 |
| CA | 2367161 | | 7/2002 |
| CA | 2460966 | | 4/2003 |
| CA | 2411819 | | 5/2003 |
| EP | 0 174 115 | | 3/1986 |
| EP | 0 054 402 | B1 | 8/1986 |
| EP | 0 897 098 | A2 | 2/1999 |
| EP | 1 306 643 | A1 | 5/2003 |
| EP | 1 443 297 | A1 | 8/2004 |
| FR | 2640371 | | 6/1990 |
| FR | 2688583 | B1 | 9/1993 |
| GB | 2022222 | A | 12/1979 |
| GB | 2109512 | A | 6/1983 |
| GB | 2132041 | A | 6/1984 |
| GB | 2 270 743 | | 3/1994 |
| SE | 459696 | | 1/1987 |
| WO | WO 87/00264 | A1 | 1/1987 |
| WO | WO 87/00265 | A1 | 1/1987 |
| WO | WO 01/59401 | A1 | 8/2001 |
| WO | WO 03/002849 | A1 | 1/2003 |
| WO | WO 03/029748 | A1 | 4/2003 |
| WO | WO 03/076868 | A1 | 9/2003 |

OTHER PUBLICATIONS

"New, Safer Explosive Detonator", World Oil, 1996, vol. 217, n. 12, p. 158 (5 pages).

Watson, John T., "Getting Electronic: Electronic detonators are gaining favor as a means of providing time delay and initiation energy", Pit and Quarry, Mar. 2001, v. 93, no. 10, p. 66 (6 pages).

"Tiny RF transceiver offers 'drop-in' wireless solution.", Product Highlights, Electronic Products, Jan. 2004, vol. 6, No. 8. http://www2.electronicproducts.com/PrintArticle.aspx?ArticleURL=hl2w1.nov2003.

"Toroid power inductors withstand extreme heat.", Product Highlights, Electronic Products, Jan. 2004, vol. 6, No. 8. http://www2.electronicproducts.com/PrintArticle.aspx?ArticleURL=hl5w3.nov2003.

Podoliak, Kathryn, "The Evolution of the Detonator", DynoConsult, New Leaders' Conference 2004, Apr. 21, 2004. http://www.oldcooperriverbridge.org/docs/dyno_nobel_shock_tube.pdf.

Rodgers, Jay A., "Measurement Technology in Mining", The Ensign-Bickford Company, 1999. http://www.dynonobel.no/NR/rdonlyres/90A8A556-8563-42D2-A47F-8EB4211385F4/0/Measurement-Technology.pdf.

BME—Products—Electronic detonators deltaDet—Remote Electronic Delay Detonator http://www.bme.co.za/pebble.asp.

Los Alamos National Laboratory—Press Release: "Slap me and I'll explode", Feb. 1997, 97-016. http://www.lanl.gov/worldview/news/releases/archive/97-016.shtml.

MREL—Portable Wireless Trigger. http://www.mrel.com/Wireless_Trigger.html.

Grant, John R., Kennedy, David L., and Beattie, Tim A., "Advanced Primer Designs", ISEE Proceedings, 1991 Research Proceedings, Abstract. http://www.isee.org/tis/Proceed/Research/91Resrch/9101r.pdf.

Leef, R.K., "An explosive situation", The REACTer, React International, Jul./Aug. 2004, vol. 38, No. 4, p. 5. http://www.reactintl.org/Reacter/paged/JA05.pdf.

Santis, Lon D., "Safety Considerations When Using Short Lead, (5-cm), Magnadet Detonators", Complete Abstracts of the ISEE Proceedings 1992 Research Symposium. http://www.isee.org/tis/Proceed/Research/92Resrch/9214r.pdf.

"Operator's Manual for the m-Comm system", Rock Mechanics Technology Limited, Issue 3c, Dec. 2003. http://www.rmtltd.com/m_comm_operators_manual.pdf.

Boucher, Craig, "Intelligent Initiation Systems", 2nd Annual Missiles & Rockets Symposium & Exhibition, May 14-16, 2001. http://www.dtic.mil/ndia/2001missiles/boucher.pdf.

Paluri, Ravi Kumar, "Fiber Optics Technology", Buzzle.com, Aug. 20, 2004. http://www.buzzle.com/editorials/text8-19-2004-58071.asp.

Take, Sopan, "RFID Technology", Buzzle.com, Apr. 26, 2004. http://www.buzzle.com/editorials/text4-26-2004-53391.asp.

Boulden, Jim, "Mobiles used in high-tech terror", CNN.com, Apr. 5, 2004. http://edition.cnn.com/2004/TECH/04/04/mobile.terror/index.html.

"Nonproliferation programs and arms control technology", Sandia Lab News, vol. 55, Feb. 2003. http://www.sandia.gov/LabNews/LN03-07-03/LA2003/la03/arms_story.htm.

Kamath, M.M., "Under Water Blasting and Dredging", Port Technology International, Edition 12, Autumn 2000, p. 58. http://www.porttechnology.org/journals/ed12/pdfs/pt12-55.pdf.

SOCOM—12 Phase I Selections from the 98.1 Solicitation, "Emergent Technologies Corp." http://www.dodsbir.net/selections/abs981socom.htm.

Hansen, R.C. and Ridgley, Richard D., "Fields of the Contrawound Toroidal Helix Antenna", ISEE Transactions on Antennas and Propagation, vol. 49, No. 8, Aug. 2001. http://www.ece.nus.edu.sg/stfpage/elelilw/Courses/Assignments/00943308.pdf.

Patent Abstracts of Japan, 04-366399, "Laser-Triggered Delay-Action Detonator", Dec. 18, 1992, F42B 3/113, F42C 19/08, H01S 3/00, Nippon Oil & Fats Co. Ltd. and Kajima Corp.

Patent Abstracts of Japan, 08-219700, "Remote Wireless Blasting Apparatus and Receiving Detonator for the Same", Aug. 30, 1996, F42D 1/055, E21D 9/00, Nippon Oil & Fats Co. Ltd.

Patent Abstracts of Japan, 2000-074597, "Remote Ignitor", Mar. 14, 2000, F42B 3/113, H01S 3/00, Rokkusu Japan:KK.

Patent Abstracts of Japan, 2001-153598, "Remote Wireless Detonation Apparatus and Power Energy Transmission Equipment and Wireless Detonator Unit Used in the Apparatus", Jun. 8, 2001, F42B 3/12, F42D 1/05, H04Q 9/00, Asahi Kasei Corp.

Patent Abstracts of Japan, 2001-330400, "Antenna for Remote Controlled Detonating Systems", Nov. 30, 2001, F42D 1/04, H01Q 1/12, Asahi Kasei Corp.

* cited by examiner

WIRELESS DETONATOR ASSEMBLIES, CORRESPONDING BLASTING APPARATUSES, AND METHODS OF BLASTING

TECHNICAL FIELD

This invention relates to the field of apparatuses and methods for improving the safety of detonators, detonator assemblies, and blasting apparatuses employing such detonators and detonator assemblies. In particular, the invention relates to assemblies, apparatuses and methods for controlling and firing detonators that are free or substantially free of physical connection to corresponding blasting machines via, for example, electronic wires or shock tube.

BACKGROUND ART

In mining operations, the efficient fragmentation and breaking of rock by means of explosive charges demands considerable skill and expertise. In most mining operations explosive charges are planted in appropriate quantities at calculated positions in the rock. The explosive charges are then actuated via detonators with predetermined time delays, thereby providing the desired pattern of blasting and rock fragmentation. Typically, signals are transmitted to the detonators via non-electric systems employing low energy detonating cord (LEDC) or shock tube. Alternatively, electrical wires may be used to transmit signals to electric detonators. More recently, the use of electronic detonators has permitted the use of programmable time delays with an accuracy of 1 ms or less.

The establishment of the blasting arrangement, and the positioning of explosive charges, is often labour intensive and highly dependent upon the accuracy and conscientiousness of the blast operator. The blast operator must correctly position explosive charges for example within boreholes in the rock, and ensure that detonators (and optionally boosters) are brought into proper association with the explosive charges. Importantly, the blast operator must ensure that the detonators are in proper signal transmission relationship with a blasting machine, in such a manner that the blasting machine can transmit a FIRE signal to actuate each detonator, and in turn actuate each explosive charge.

Electronic blasting systems that involve direct electrical communication between the blasting machine and the detonators may permit the use of more sophisticated signaling. For example, such signaling may include ARM, DISARM, and delay time instructions for remote programming of the detonator firing sequence. Moreover, as a security feature, detonators may store firing codes and respond to ARM and FIRE signals only upon receipt of matching firing codes from the blasting machine.

To respond to such command signals, electronic detonator systems may comprise programmable circuitry that enables receipt, memory storage, and processing of the incoming signals. However, this programmable circuitry can itself present safety issues. For example, the power supply for the programmable circuitry may inadvertently trigger the firing circuitry of the detonator, resulting in unintentional actuation of the detonator base charge.

Systems and methods have been developed to help avoid the possibility of inadvertent detonator actuation by command signals received by the detonator, thereby improving the safety of the blasting arrangement. For example, U.S. Pat. No. 6,644,202 issued Nov. 11, 2003 discloses a method of establishing a blasting arrangement by loading at least one detonator into each of a plurality of blast holes, placing explosive material in each blast hole, connecting to a trunk line a control unit that has a power source incapable of firing the detonators, sequentially connecting the detonators, by means of respective branch lines, to the trunk line and leaving each detonator connected to the trunk line. In a preferred embodiment, the control unit includes means for receiving and storing in memory means identity data from each detonator, means for generating a signal to test the integrity of the detonator/trunk line connection and the functionality of the detonator, and means for assigning a predetermined time delay of each detonator to be stored in the memory means. In this way, the control unit can communicate with the detonators via a direct electrical connection (i.e. the trunk line). However, the power source in the control unit that enables the communication is too small to risk inadvertent detonator actuation.

Other improvements in the safety of blasting relate to the development of wireless detonators and corresponding detonator systems. Persons of skill in the art recognize the potential of wireless detonator systems for significant improvement in safety at the blast site. By avoiding the use of physical connections (e.g. electrical wires, shock tubes, LEDC, or optical cables) between detonators, and other components at the blast site (e.g. blasting machines) the possibility of improper set-up of the blasting arrangement is reduced. With traditional, "wired" blasting arrangements (wherein the wires can include e.g. electrical wires, shock tubes, LEDC, or optical cables), significant skill and care is required by a blasting operator to establish proper connections between the wires and the components of the blasting arrangement. In addition, significant care is required to ensure that the wires lead from the explosive charge (and associated detonator) to a blasting machine without disruption, snagging, damage or other interference that could prevent proper control and operation of the detonator via the attached blasting machine. Wireless blasting systems offer the hope of circumventing these problems.

Another advantage of wireless detonators relates to facilitation of automated establishment of the explosive charges and associated detonators at the blast site. This may include for example automated detonator loading in boreholes, and automated association of a corresponding detonator with each explosive charge. Automated establishment of an array of explosive charges and detonators at a blast site, for example by employing robotic systems, would provide dramatic improvements in blast site safety since blast operators would be able to set up the blasting array from entirely remote locations. However, such systems present formidable technological challenges, many of which remain unresolved. One obstacle to automation is the difficulty of robotic manipulation and handling of detonators at the blast site, particularly where the detonators require tieing-in or other forms of hook up to electrical wires, shock tubes or the like. Wireless detonators and corresponding wireless detonator systems may help to circumvent such difficulties, and are more amenable to application with automated mining operations. In addition, manual set up and tieing in of detonators via physical connections is very labour intensive, requiring significant time of blast operator time. In contrast, automated blasting systems are significantly less labour intensive, since much of the set procedure involves robotic systems rather than blast operator's time.

Progress has been made in the development wireless detonators, and wireless blasting systems that are suitable for use in mining operations, including detonators and systems that are amenable to automated set-up at the blast site. Nonetheless, existing wireless blasting systems still present significant safety concerns, and improvements are required if wireless systems are to become a viable alternative to traditional "wired" blasting systems.

DISCLOSURE OF THE INVENTION

It is an object of the present invention, at least in preferred embodiments, to provide a detonator assembly or corresponding blasting apparatus that is wireless with regard to communication links between a blasting machine and associated detonator assemblies.

It is another object of the present invention, at least in preferred embodiments, to provide a detonator assembly in which the risk of inadvertent activation of the firing circuit, and actuation of the base charge is essentially eliminated.

It is yet another object of the present invention, at least in preferred embodiments, to provide a method for wireless communication between a blasting machine and at least one detonator assembly.

In one aspect the invention provides for a detonator assembly for use in connection with at least one blasting machine that transmits at least one wireless command signal via a first medium, the detonator assembly comprising:

a base charge;

a command signal receiving and processing means for wirelessly receiving and processing said at least one command signal from said at least one blasting machine;

an active power source to power said command signal receiving and processing means;

a power receiver for wirelessly receiving via a second medium power transmitted by a power emitter;

converting means for converting said power received from the power receiver to electrical power;

a passive power source in electrical connection with the converting means, the passive power source capable of storing said electrical power derived from said converting means thereby to charge the detonator; and a firing circuit in connection with said base charge, for selectively receiving said electrical power stored in said passive power source, said active power source generating a power insufficient to activate said firing circuit and actuate said base charge; whereupon receipt of a command signal to FIRE by said command signal receiving means causes release of said electrical power from said passive power source into said firing circuit thereby to actuate said base charge.

In another aspect the invention provides for a blasting apparatus comprising:

at least one blasting machine capable of transmitting command signals to associated detonators via wireless communications via a first medium;

at least one explosive charge;

at least one detonator assembly of the present invention associated with each explosive charge and in signal communication with said at least one blasting machine;

at least one power emitter for transmitting power via a second medium to each detonator assembly for receipt thereby in a suitable form to charge each detonator assembly for firing in response to a FIRE command signal from said at least one blasting machine; and optionally a central command station for controlling said at least one blasting machine.

In another aspect the invention provides for a method of blasting at a blast site, the method comprising the steps of:

providing a blasting apparatus of the invention;

placing a plurality of explosive charges at the blast site;

associating each detonator assembly with an explosive charge such that actuation of each detonator assembly will cause actuation of each associated explosive charge;

targeting said power emitted from said power emitter to said at least one detonator assembly to cause each detonator assembly to receive said emitted power and convert said emitted power to electrical energy thereby to charge each detonator assembly for firing; and transmitting at least one command signal from said at least one blasting machine to cause each detonator assembly to discharge said electrical power into said firing circuit, thereby causing actuation of each base charge.

In another aspect the invention provides for a use of a detonator assembly of the invention, in a mining operation.

In another aspect the invention provides for a use of the blasting apparatus of the invention, in a mining operation.

DEFINITIONS

Figure 1:
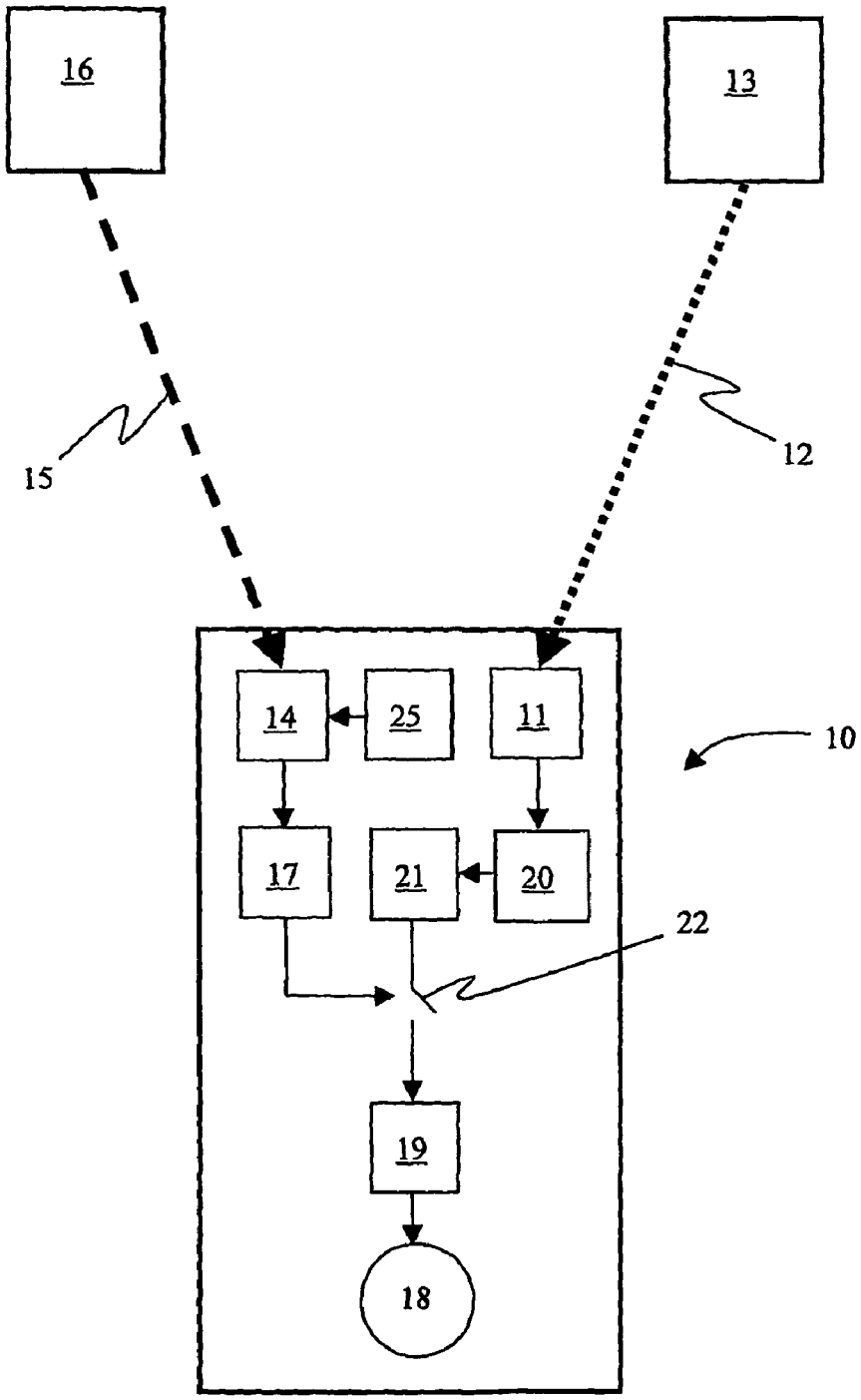
FIG. 1 schematically illustrates one preferred embodiment of a wireless detonator assembly of the invention in the context of a corresponding blasting apparatus.

For the purposes of this specification, light energy and optical energy are considered to mean the same and encompass the same range of electromagnetic wavelengths, the range including wavelengths defined by the visible division of the electromagnetic spectra.

Active power source: refers to any power source that, when active, can provide a substantially continuous or generally constant supply of electrical energy. This definition encompasses devices that direct current such as a battery or a device that provides a direct or alternating current. Typically, an active power source provides power to a command signal-receiving and/or processing means, to permit reliable reception and interpretation of command signals derived, for example, from a blasting machine.

Automated/automatic blasting event: encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting machine: any device that is capable of being in signal communication with electronic detonators, for example to send command signals such as ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device to collect detonator information and transfer the information to the blasting machine.

Command signal receiving means/command signal processing means: refers to any device or software able to carry our command signal receiving and/or processing. Such devices may form separate or entirely integrated components.

Charge/charging: In the context of this specification refers to the act of causing a detonator of the invention to receive energy or power from a remote source, and convert the energy or power into electrical energy that may ultimately be used in activating a firing circuit to cause actuation of an associated base charge upon receipt of appropriate command signals. 'Charging' and 'powering-up' have substantially the same meaning in the context of the present invention and may relate to the charging of a passive power source.

Converting means: refers to any component or device that is able to convert energy or power received wirelessly from a remote source, into electrical energy useful to charge the detonator assembly. For example, when the energy is light energy, the converting means is a photovoltaic cell or a photodiode.

Detonator: refers to any device comprising a base charge, and means to receive a signal to actuate the base charge. Typically, but not necessarily, a detonator may comprise a detonator shell, of metal or some other material suitable to enclose components such as the base charge. Typically, but not necessarily, the base charge may be positioned at a percussion/actuation end of a detonator, opposite a signal receiving end.

Detonator assembly: refers to any assembly of components including detonator components suitable for receiving one or more command signals and causing actuation of a base charge upon receipt of a command signal to FIRE. In selected embodiments presented herein, the detonator assembly may further include components to substantially prevent unintentional detonator actuation. Such components may be selected from one or more of the following non-limiting list:

a base charge;

a command signal receiving means for wirelessly receiving said at least one command signal from said at least one blasting machine; command signal processing means for processing said at least one command signal;

an active power source to power said command signal receiving and/or processing means;

a power receiver for wirelessly receiving power transmitted by a power emitter;

converting means for converting said power received from the power receiver to electrical power;

a passive power source in electrical connection with the converting means, the passive power source capable of storing said electrical power derived from said converting means thereby to charge the detonator; and a firing circuit in connection with said base charge, for selectively receiving said electrical power stored in said passive power source, said active power source generating a power insufficient to activate said firing circuit and actuate said base charge; whereupon receipt of a command signal to FIRE by said command signal receiving means causes release of said electrical power from said passive power source into said firing circuit thereby to actuate said base charge.

Electromagnetic energy: encompasses energy of all wavelengths found in the electromagnetic spectra. This includes wavelengths of the electromagnetic spectrum division of γ-rays, X-rays, ultraviolet, visible, infrared, microwave, and radio waves including UHF, VHF, Short wave, Medium Wave, Long Wave, VLP and ULF. Preferred embodiments use wavelengths found in radio, visible or microwave division of the electromagnetic spectrum.

Power emitter: encompasses any source of power or energy that is capable of wirelessly transmitting power or energy to a detonator for the purpose of 'powering-up' or 'charging' the detonator for firing. In preferred embodiments the power emitter may comprise a source of electromagnetic energy such as a laser or microwave source.

Medium/media or "forms" of energy: In accordance with the present invention, a medium for transmitting power may take any form appropriate for wireless communication and/or wireless charging of the detonators. For example, such forms of energy or power may include, but are not limited to, electromagnetic energy including light, infrared, radio waves (including ULF), and microwaves, or alternatively make take some other form such as electromagnetic induction or acoustic energy. In addition, "forms" of energy may pertain to the same type of energy (e.g. light, infrared, radio waves, microwaves etc.) but involve different wavelengths or frequencies of the energy. Generally, a detonator assembly of the invention will receive two different forms of energy involving different media, and distinguish one form from another in accordance with the teaching provided herein.

Electromagnetic energy receiving means: encompasses any means that is capable of receiving electromagnetic energy such as light energy, radio waves, or microwaves, and transferring at least some of the electromagnetic energy to a converting means for conversion of the electromagnetic energy to electrical energy. For example, the means may include a light capture device that may include optical components such as mirrors or prisms to direct the light energy in a desired fashion. Furthermore, the light energy receiving means may include means for directing or transporting the light energy to another discrete location, for example via an optical cable or fibre.

Electromagnetic induction energy receiving means: includes any device capable of receiving energy such as electrical energy transferred thereto via electromagnetic induction. For example, such means may comprise a magnetic coupling device such comprising a magnetic, metallic material. In preferred embodiments, the magnetic coupling device may comprise a device such as described, for example, in U.S. Pat. No. 6,618,237, which is incorporated herein by reference. In further preferred embodiments, the magnetic coupling device may have an opening therein configured to receive a conductive wire extending therethrough, with said magnetic coupling device generating output signals based on currents passing in the wire. For example, the wire extending therethrough may selectively carry a current suitable for inducing magnetic flux in the magnetic coupling device, whereby the magnetic flux can be utilized to transfer electric current into a wire wound around the magnetic coupling device. In most preferred embodiment the magnetic coupling device comprises a toroidal element such as for example illustrated in FIG. 4.

Passive power source: includes any electrical source of power that does not provide power on a continuous basis, but rather provides power when induced to do so via external stimulus. Such power sources include, but are not limited to, a diode, a capacitor, a rechargeable battery, or an activatable battery. Preferably, a passive power source is a power source that may be charged and discharged with ease according to received energy and other signals. Most preferably the passive power source is a capacitor.

Power emitter: any source of wirelessly transmitted power or energy wherein the power or energy is suitable for receipt by a detonator assembly of the invention. Such a power transmitter may include any freespace optical or electromagnetic energy emitter, or another source of energy such as an acoustic source or a source of electrical energy for electromagnetic induction.

Preferred/preferably: refers to preferred features of the broadest embodiments of the invention, unless otherwise stated.

Source of light energy: may take any source that is capable of producing a form of light energy sufficient to "charge" a detonator from a remote location. Such a source may include, but is not limited to, a filament light bulb, a laser, a laser diode, or an LED diode or any form of freespace optical transmission. Moreover, the source of light energy may form an integral part of a blasting machine, but alternatively may form a distinct source or entity that is physically distinct from the blasting machine and operated separately.

Wireless: refers to there being no physical wires (such as electrical wires, shock tubes, LEDC, or optical cables) connecting the detonator assembly of the invention or components thereof to an associated blasting machine or power source. Wireless includes communication of command signals to a detonator assembly of the invention, as well as the transfer of power or energy via wireless means to the detonator assembly of the invention. Wireless may include, at least in selected embodiments, the use of essentially or partially wireless communications systems. For example, wireless may include the use of electromagnetic induction for transferring electrical energy to 'charge' detonator assemblies for firing. Although wires may be used in such embodiments, and such wires come into close proximity with one another and other components, there may still be no physical connection between a blasting machine and detonator assembly. As such, these systems employing electromagnetic induction are within the realms of wireless systems within the scope and meaning of the teachings of the present application.

MODES FOR CARRYING OUT THE INVENTION

Wireless blasting systems circumvent the need for complex wiring systems at the blast site, and associated risks of improper placement, association and connection of the components of the blasting system. However, the development of wireless communications systems for blasting operations has presented significant new challenges for the industry, including new safety issues.

Through careful investigation, the inventors have determined that the wireless detonators and blasting systems of the prior art are problematic with regard to inadvertent or accidental actuation of the detonators. Rapid and accurate communication between a blasting machine, and associated detonators represents a difficult challenge, regardless of the nature of the wireless communication systems. One of the most important signals that must be properly and accurately processed by a wireless detonator is the signal to FIRE. Failure of the communication systems to fire detonators on command can result in a significant risk of serious injury or death for those blast operators working at the blast site. Therefore, prevention of inadvertent detonator actuation is of paramount importance to blasting operations.

The present invention provides, at least in preferred embodiments, for detonator assemblies, corresponding blasting apparatuses comprising the detonator assemblies, and methods involving the detonator assemblies that significantly reduces the risk of inadvertent detonator actuation. The detonator assemblies of the present invention utilize known components to provide a way to substantially avoid inadvertent detonator actuation. The inventors have succeeded in the development of an 'intrinsically safe' detonator assembly and corresponding blasting system that avoids the need for wires or other physical connections between a blasting machine and one or more detonator assemblies associated with the blasting machine. In this way, a blasting operator working at a blast site can position explosive charges, associate detonator assemblies with the explosive charges and move away from the blasting site prior to firing, without the need to establish and lay a multitude of wire connections between the components of the blasting apparatus. Not only does this reduce the time and cost of the blasting operation, but the safety of the overall apparatus is improved.

In preferred aspects of the invention, the developments may facilitate automated manipulation of the detonator assemblies. Without the need to make physical connections (e.g. electrical wires, shock tubes, LEDC, or optical cables) between detonator assemblies and blasting machines or power sources, the detonator assemblies may be loaded into boreholes more easily via automated set-up means, for example employing robotic systems. In this way, a blasting operator may spend less time in proximity to explosives at the blast site, thereby removing the worker from harms way.

The present invention, at least in part, involves the use of one form of energy to communicate with the detonators, and another distinct form of energy to 'power-up' or 'charge' the detonator assemblies and bring them into a suitable state for firing. Each form of energy is distinguishable from the other form, and this distinction is detectable by the detonator of the invention. As will become evident from the present disclosure, the form of energy that is used for general communication with the detonator assemblies of the invention is less likely to accidentally or inadvertently trigger actuation of the detonator base charge. For actuation to occur, two separate and distinct forms of energy must target the detonator assembly, otherwise the detonator assembly will substantially remain in a "safe mode".

The "forms" of energy may take any form appropriate for wireless communication and/or wireless charging of the detonator assemblies, transmitted, for example, via different media. For example, such forms of energy may include, but are not limited to, electromagnetic energy including light, infrared, radio waves (including ULF), and microwaves, or alternatively may take some other form such as electromagnetic induction or acoustic energy. In preferred aspects, the same type of energy for example selected from the group above, may be used both for communicating with the detonator assembly via command signals (e.g. from a blasting machine) as well as for 'charging' or 'powering-up' the detonator assembly. However, in such circumstances where the same type of energy is used for both purposes, the nature of the energy must be differentiated by the detonator assembly of the invention such that incoming command signals and incoming energy or power to power-up the detonator assembly do not become confused. In one example, if the detonator assembly of the invention employs and receives microwaves both for the purposes of communication with a blasting machine via command signals, and for receiving energy to power-up for firing, then the detonator assembly may differentiate each form of microwave energy on the basis of differing wavelength or frequencies. Clearly, where a detonator assembly of the invention employs a different type of energy for communication compared to powering-up then the need to differentiate the energies on the basis of wavelength or frequency is reduced. For example a detonator assembly of the invention may receive light energy for the purpose of powering-up the detonator assembly for firing, and radio waves for general communications with a blasting machine. Indeed, this pertains to a particularly preferred embodiment of the invention. Under such circumstances, alternative light and radio receiving devices on the detonator assembly will ensure that the power-up and general communication signals remain distinct.

The invention contemplates the use of a detonator assembly comprising a small power source of sufficient strength to power wireless radio communications circuitry in the detonator assembly, to receive for example ARM, DISARM, and FIRE signals, detonator delay times and associated firing codes from an associated blasting machine. However, the power source is preferably of insufficient strength to cause actuation of the base charge via the firing circuitry. As discussed, a substantially separate and distinct system is utilized to 'power-up' or 'charge' the detonator assembly, thereby to permit the base charge to be fired in response to one or more appropriate command signals. For example, the invention contemplates the use of received electromagnetic energy such as light energy or microwave energy to power the firing circuit for actuation of the base charge. In this way, each detonator assembly may be programmed with and respond to command signals received from a blasting machine via RF communication. However, each detonator assembly will not respond to a command signal to FIRE unless it is effectively primed ready to fire by virtue of received electromagnetic energy (which has been converted into electrical energy for the firing circuit). Therefore, wireless communication by an associated blasting machine with the detonator assembly, for example to communicate ARM, DISARM, or FIRE signals, as well as delay times and firing codes, will substantially not cause inadvertent base charge actuation since the intrinsic nature of the detonator assembly is to be in a "safe mode". In accordance with the invention, the detonator assembly will only be in a position to fire if the detonator assembly is already, or subsequently "charged" by a source of energy of an entirely distinct form (e.g. a different wavelength or frequency) compared to the command signal communications systems of the blasting machine. This entirely distinct form of energy is responsible for providing an input of energy to the detonator assembly sufficient to activate the firing circuit and actuate the base charge upon receipt of a FIRE signal from the blasting machine.

A person of skill in the art will appreciate that the nature of the signal or power source for communication by the blasting machine, or for charging the detonator assembly can vary. For example, any wireless means of transferring signals and energy may be utilized in accordance with the detonator assemblies of the present invention to achieve both wireless communication from a blasting machine (i.e. the transfer of command signals), as well as the transfer of energy or power to 'charge' or 'power-up' the detonator assembly for firing. The detonator assemblies of the invention can distinguish between wireless communications for the purposes of general communication, and wireless communications for charging. Furthermore, a single type of energy (e.g. light energy) may be used to both power-up the detonator assemblies for firing and for transmitting command signals to control the detonators, providing that a different wavelength is used for power-up than for transmitting command signals, so that the detonator assembly can effectively distinguish between the two. For example, in particularly preferred embodiments, a higher wavelength, and therefore lower energy, light signal may be used for transmitting command signals while a lower wavelength, and therefore higher energy, light signal may be used for transmitting light energy for powering up the detonator assembly. Such forms of light energy may, for example, take the form of red and blue laser light respectively. Moreover, other wireless means may also be used for communication with the detonator assemblies, or for transfer of energy for powering-up the detonator assemblies, including for example infrared, radio waves (including ULF), microwaves and other forms of electromagnetic energy, electromagnetic induction and acoustic energy.

In other embodiments, the detonator assembly of the present invention may be charged via the transfer of power from an electromagnetic induction energy receiving means. Such means may include any device capable of receiving energy such as electrical energy transferred thereto via electromagnetic induction. For example, such means may comprise a magnetic coupling device such as a device comprising a magnetic/metallic material. In preferred embodiments, the magnetic coupling device may comprise a device such as described, for example, in U.S. Pat. No. 6,618,237, which is incorporated herein by reference. In further preferred embodiments, the magnetic coupling device may have an opening therein configured to receive a conductive wire extending therethrough, with the magnetic coupling device generating output signals based on currents passing in the wire. For example, the wire extending therethrough may selectively carry a current from a source of energy for charging the detonator assembly, wherein the current in the wire is suitable for inducing magnetic flux in the magnetic coupling device, which can then be utilized to transfer electric current into a wire wound around the magnetic coupling device for charging the detonator assembly. In most preferred embodiment the magnetic coupling device comprises a toroidal element such as for example illustrated with reference to FIG. 4 (described below). The use of a magnetic coupling device may involve no physical connection between a current-carrying wire running therethrough, and the magnetic coupling device. Therefore, in the context of the present invention, the magnetic induction constitutes a form of wireless (or at least partially wireless) energy transmission.

A preferred embodiment of the invention will now be described with reference to FIG. 1. A detonator assembly is shown generally at 10. The detonator assembly comprises a power receiving means which in this case is a light energy receiving means 11 for receiving light 12 derived from a power emitter, which in this case takes the form of laser 13. However, the light energy receiving means can alternatively be an electromagnetic energy receiving means (not shown) for receiving any form of electromagnetic energy or any other forms of power receiver. In one preferred embodiment, microwave energy is received from any known microwave energy source. In such a case the electromagnetic energy receiving means is a microwave energy receiving means. In addition the detonator assembly 10 includes a command signal receiving means 14 for receiving and optionally processing command signals 15 transmitted as radio waves from a blasting machine 16. The received command signals undergo signal processing 17.

It will be noted in FIG. 1 that the detonator assembly 10 includes a base charge 18 connected to other components of the detonator via a firing circuit 19. In addition, the detonator 10 includes converting means 20 for converting the light energy received by the light energy receiving means 11 to electrical power. In turn, the electrical power is temporarily stored in a passive power source 21, which preferably takes the form of a capacitor. The passive power source is connected to the firing circuit via a firing switch 22. The firing switch 22 remains open, preventing electrical communication between the passive power source 21 and the firing circuit 19. The command signal processing means 17 (which in selected embodiments may be integrated with command signal processing means 14) can receive and process several different types of command signals (not shown). However, the command signal processing means will only cause closure of the firing switch 22 if a FIRE command signal is received by the blasting machine 16.

Therefore, the detonator assembly 10 illustrated in FIG. 1 will only fire if the following two conditions are met:

firstly that the light energy receiving means 11 receives sufficient light energy 12 from laser 13 to cause the generation and storage of sufficient electrical power via the converting means 20 and the passive power source 21 to activate the firing circuit 19 and actuate the base charge 18; and secondly that the command signal receiving means 14 receives a FIRE signal via the radio signals 15 received from the blasting machine 16 to cause closure of the firing switch 22, thereby to bring the passive power source 21 into electrical communication with the firing circuit 19, to allow discharge of the electrical power stored in the passive power source 21 into the firing circuit 19 to actuate the base charge 18.

The embodiment of the invention illustrated in FIG. 1 further includes an active power source 25 to provide power to the command signal receiving and processing means. In this way, the receiving and processing circuitry for the command signals is generally always primed ready to receive command signals from the blasting machine.

It will be appreciated that the embodiment of the invention illustrated in FIG. 1 requires the input of two physically distinct signals from two distinct sources of energy via two distinct media to actuate the base charge. Nonetheless, the invention also encompasses more complex embodiments of the invention to that illustrated in FIG. 1. For example, the command signals derived from the blasting machine may further include delay times and security features such as firing codes, which may be processed and stored by the detonator assembly. Furthermore the firing codes may be compared to pre-programmed firing codes to ensure that the command signals are credible and not a result of illicit or accidental use of the blasting machine or other components of the blasting system. For example, in accordance with known security systems, the command signal processing means may only process and accept a FIRE signal if a firing code has been received that corresponds to a pre-programmed firing code. The embodiments and aspects of the present invention are intended to work in conjunction with existing technology for secure blasting that is well known in the art, as desired.

Figure 2:
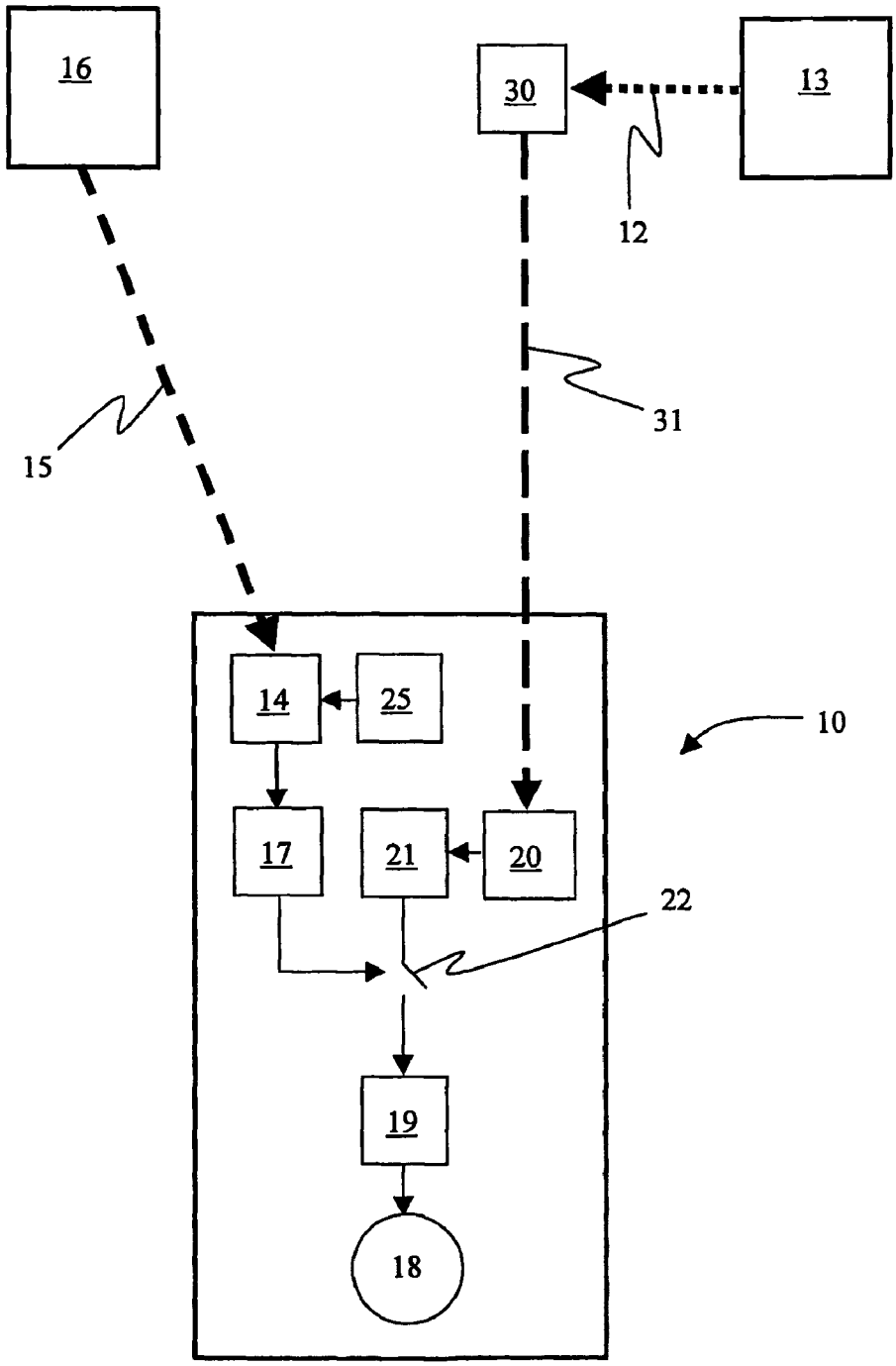
FIG. 2 schematically illustrates one preferred embodiment of a wireless detonator assembly of the invention in the context of a corresponding blasting apparatus.

Although not illustrated in FIG. 1, it will be appreciated that components of the detonator assembly may be located outside of the detonator shell. For example, the light energy receiving means may take the form of an antennae extending to a position remote from the detonator shell. One embodiment that encompasses this concept is illustrated with reference to FIG. 2, in which all of the components of the detonator assembly are the same as those in FIG. 1, with the exception of the light energy receiving means 11. For the purposes of additional clarity and detail, the light energy receiving means takes the form of a light capture device 30, and an optical cable 31 connecting the light capture device 30 to the converting means 20. In this way, the light capture device may be positioned for example above the ground in a position suitable to receive or intercept light energy emanating from the laser 13. In contrast the other components of the detonator assembly may be located below the ground, or embedded in a borehole in the rock. Although not illustrated, the invention further encompasses the use of a light capture device located away from the other components of the detonator assembly (as shown in FIG. 2) except that the converting means and potentially other components of the detonator assembly are located in a similar position adjacent or near to the light capture means. In this embodiment, the light energy could be converted to electrical power above the ground or rock, and transferred below ground to actuate the base charge via an electrical connection.

The laser 13 is preferably a directable laser or a series of lasers which can provide light energy to an array of detonator assemblies. In this way, the blasting apparatuses may be established such that each detonator assembly, or at least each light receiving means of each detonator assembly, is within site of a source of light energy such as a laser. Optionally, the source of light energy may form an integral part of a blasting machine, or alternatively the source of light energy may take the form of an entirely separate component of group of components. In accordance with the present invention, it should also be noted that each light receiving means of each detonator assembly may be targeted by one or more sources of light energy (e.g. lasers). This will help to ensure that the detonator assemblies are properly 'charged' at the required time, and help to nullify any dirt that might be present on the light receiving means.

In a preferred embodiment, the wireless communication with the blasting machine preferably involves two-way communication to permit receipt by the blasting machine of transmissions from the detonator assembly with regard, for example, to the status of the detonator assembly, delay times, firing codes etc.

In another embodiment, the present invention also provides for a blasting apparatus comprising a central command station remote from the blasting site for controlling the blast operation, as well as one or more blasting machines capable of receiving command signals from the central command station and effectively relaying the signals to a plurality of associated detonators.

Figure 3:
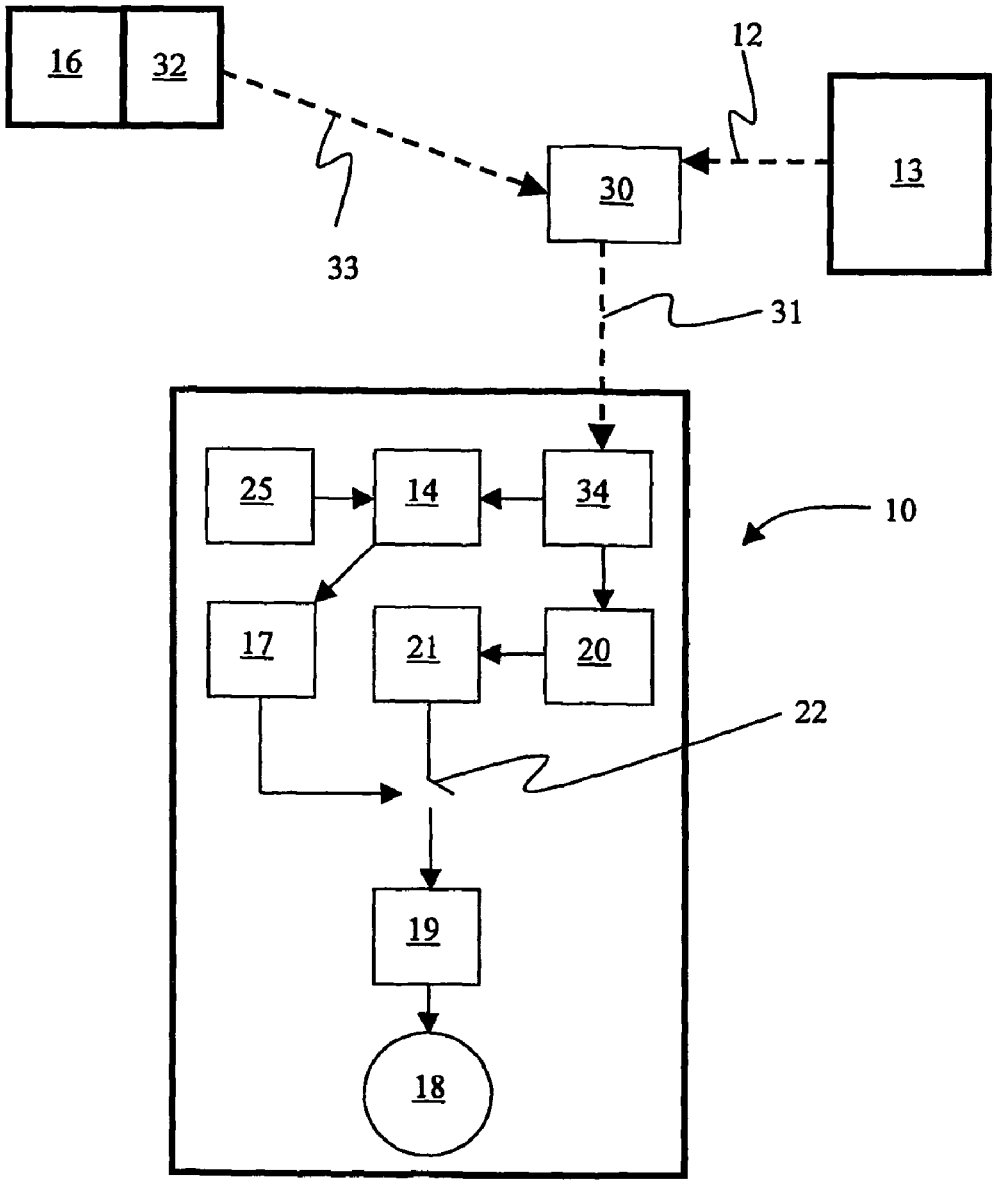
FIG. 3 schematically illustrates one preferred embodiment of a wireless detonator assembly of the invention in the context of a corresponding blasting apparatus.

Although not illustrated in FIG. 1 or FIG. 2 it will be appreciated that a single type of energy such as light energy can be used to transmit both the energy required to power-up the detonator assembly and to transmit command signals to control the detonator assembly. In the case of light energy, this can be done using a different wavelength to transmit command signals and light energy for power-up of the detonator assembly. One embodiment that illustrates this feature is shown in FIG. 3 where two lasers each provide light energy of a different wavelength, one for transmitting command signals, the other for providing power to be stored for actuation of the base charge. Blasting machine 16 uses an additional laser 32 which transmits a light energy beam 33 to the light capture device 30. Energy beam 33 is of a higher wavelength, therefore lower energy, than the light energy 12 produced by laser 13. The higher wavelength light energy 33 is used to transmit command signals to the detonator in place of radio signals 15 of FIG. 1 or FIG. 2. The blasting machine 16 communicates to the additional laser 32 using known methods, but preferably using wireless methods or direct electrical communication. Alternatively, laser 32 may form an integral component of the blasting machine.

In a particularly preferred embodiment, a blue laser with short wavelength light is used for powering up for its higher energy transfer efficiency and a red laser with longer wavelength light is used for transmitting command signals. The detonator assembly 10 is substantially the same as in previous embodiments except in that an optical filter 34 is added to decipher the wavelength of the incoming light energy. The light energy having a lower wavelength is filtered and directed to the converting means 20. The light energy having a higher wavelength is filtered and directed to the command signal receiving means 14. Once received by the converting means and the command signal receiving means, the signals are processed as described above.

The optical filter 34 can optionally be replaced by a further light energy receiving means (not shown in FIG. 3). In such an arrangement, light energy of a first wavelength for transmitted energy for storage would be directed to the first light energy receiving means for transfer to the energy converting means 20. Light energy of a second wavelength for transmitting command signals is directed to the second light energy receiving means for transfer to the command signal receiving and processing means 14. By using one light energy receiving means for each wavelength received, there is no specific need for an optical filter to separate the wavelengths of light. If more than two types of wavelength are required, than a plurality of light energy receiving means can be used, or an optical filter can be used. A plurality of light energy receiving means can also be used with one or more optical filters if necessary. It will be appreciated that the first and second wavelengths can transmit either command signals or energy for storage.

In further embodiments similar to that shown in FIG. 3, the dual laser arrangement may be used with either the arrangement outlined in FIG. 1 where light energy receiving means 11 are internal to the detonator assembly 10, or where the light energy receiving means takes the form of a light capture device 30 as outlined in FIG. 2. Further, it will be appreciated that any known light energy sources can be used which serve to emit the appropriate wavelength of light. Moreover, a single light energy source may be used that is capable of emitting light energy of two separate and distinct wavelengths for receipt by the detonator.

Figure 4:
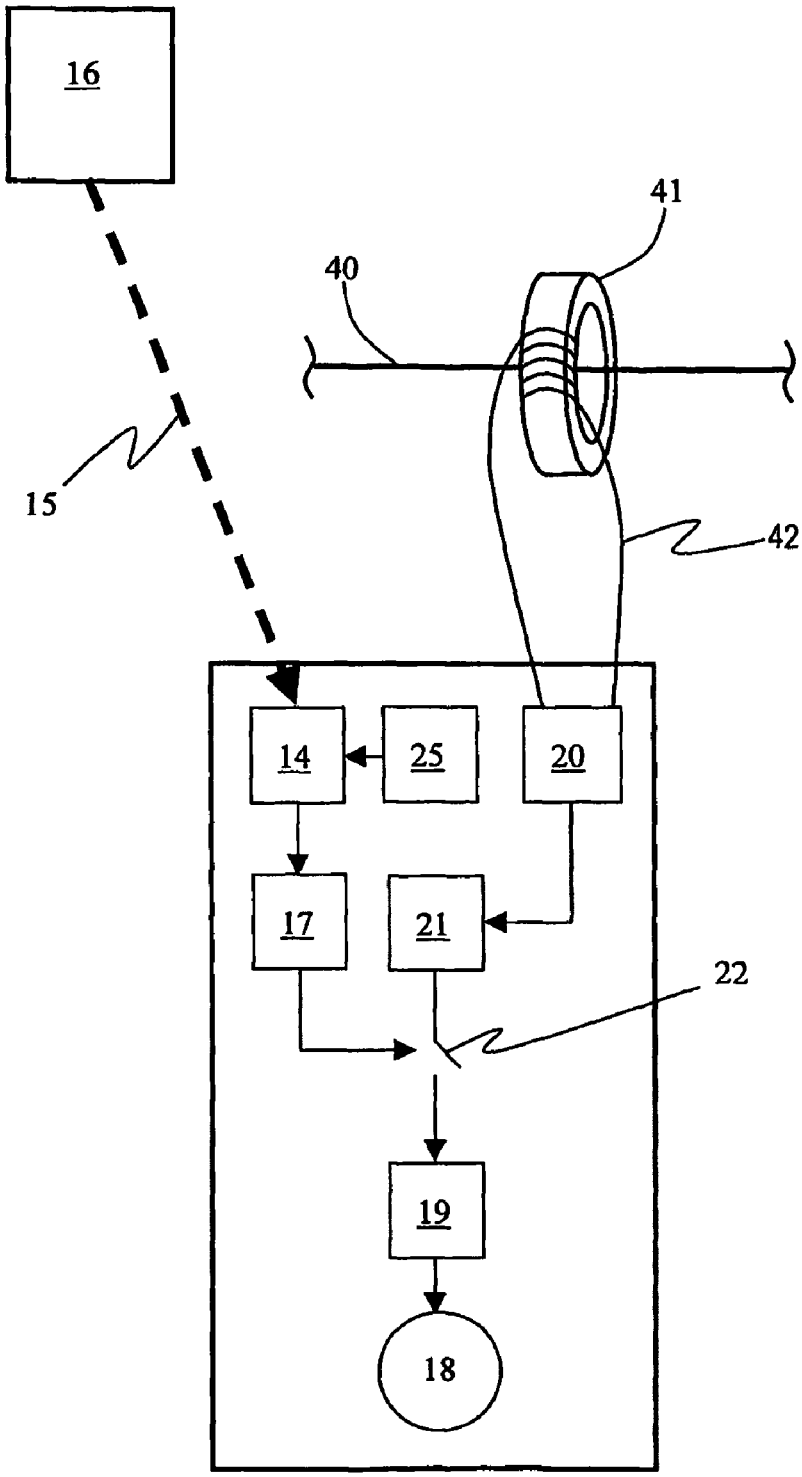
FIG. 4 schematically illustrates one alternative embodiment of a wireless detonator assembly of the invention in the context of a corresponding blasting apparatus.

An alternative embodiment of the invention involving electromagnetic induction is now described with reference to FIG. 4. This embodiment includes many components similar or identical to those shown in FIG. 1, 2, or 3. However, the power to charge the detonator assembly is, in this case, captured or harnessed via electromagnetic induction rather than via some other wireless means. In FIG. 4 there is shown a wire 40 for selectively carrying current derived from a power source (not shown). The power source (not shown) may form part of a blasting machine or central command station, or alternatively may be a separate entity. In any event, the wire 40 is arranged such that it passes through a toroidal magnetic coupling device 41, and in doing so induces magnetic flux in the magnetic coupling device when a current is carried by the wire. This magnetic flux is effectively converted back to electrical energy in lead in wire 42, which is wound around a portion of the toroidal magnetic coupling device 41 and connected to another component of the detonator assembly 10. In the embodiment illustrated, the lead in wire 42 is connected to the converting means 20, for conversion to a form of electrical power more suited for charging the passive power source 21. In alternative embodiments, it may be possible to connect the lead in wire 42 directly to the passive power source for charging thereof upon application of a suitable current from the power source to wire 40. In this case, the requirement for a converting means may, at least in some selected embodiments, be essentially eliminated.

Although the embodiment illustrated in FIG. 4 is not entirely "wireless" in the strictest sense, it nonetheless lies within the spirit and scope of the invention. The use of magnetic induction as a means to transfer energy for charging detonator may provide an alternative form of energy distinct from that used for general command signal communications 15 from blasting machine 16. For this reason, the detonator assembly 10 can effectively distinguish command signals from signals for charging, and the base charge will actuate only if:

(1) the passive power source 21 is charged or sufficiently charged via electromagnetic induction through wire 40, magnetic coupling device 41 and lead in wire 42; and (2) the blasting machine 16 transmits a command signal 15 (e.g. via radio waves or electromagnetic energy) to FIRE, received and processed via the command signal receiving means 14 (and processed by processing means 17), thereby to cause closure of firing switch 22 and discharge of stored electrical energy into the firing circuit 19, resulting in actuation of base charge 18.

Although the use of a toroidal transfer of the type illustrated in FIG. 4 is known in the art, such uses traditionally involve command signal or other general communication with a detonator/detonator assembly. This contrasts with the present invention, which contemplates the use of magnetic induction either for command signal communication, or for charging of detonator assemblies for firing. For the purposes of charging, the winding of lead in wire 42 about the toroidal magnetic coupling device 41 may be less precise compared to equivalent devices for communicating command signals. After all, the purpose of the toroidal device in this embodiment is for charging, and failure of the toroidal device will result in a lack of or insufficient charging. This may not pose a significant danger to a blast operator, since the detonator assembly will not be in a position to actuate. This contrasts with a failure of a toroidal device to transfer command signals, which may render uncertain the status of the detonator assembly, with inevitable safety concerns. It follows that toroidal transformers for charging purposes may be less precise, and greater manufacturing tolerances may be acceptable, compared to toroidal transformers for transferring command signals. For example, such devices may have less precise winding of the lead in wire 42 about the toroid 41.

In another embodiment the present invention provides for a blasting apparatus comprising:

at least one blasting machine capable of transmitting at least one command signal to at least one detonator assembly of the invention via wireless communications via a first medium;

at least one explosive charge;

at least one detonator assembly according to the present invention associated with each explosive charge and in signal communication with said at least one blasting machine;

at least one power emitter for transmitting power via a second medium to each detonator assembly for receipt thereby in a suitable form to charge each detonator assembly ready for firing at least in response to a FIRE command signal from said at least one blasting machine; and optionally at least one central command station for controlling said at least one blasting machine.

The detonator assemblies and blasting apparatuses of the present invention have been principally described to employ a single communication device for transmitting command signals, and a single power source for transmitting energy to 'charge' the detonator assembly. However, it will be appreciated that the invention encompasses detonator assemblies (and corresponding blasting systems) that are able to receive command signals from more than one source, for example a plurality of blasting machines. In addition, it will be appreciated that the invention encompasses detonator assemblies that are able to wirelessly receive power/energy for the purposes of charging from two or more sources. For example, a plurality of lasers may target a single detonator assembly, and the targeted detonator assembly may receive the energy from several lasers. Without wishing to be bound by theory, it is considered that by targeting a detonator assembly by more than one source of energy, the possibility of improper charging is reduced. For example, any given detonator at the blast site may be 'blind' to receive energy from a selected laser by reason of inadvertent obstruction of the light path to the detonator assembly from the laser. By targeting the detonator assembly with multiple lasers from different angles this possibility is reduced.

It will be further appreciated that the detonator assemblies of the present invention can be positioned in a blast array. Moreover, one or more of the detonator assemblies of the array may be positioned, manipulated and/or loaded into boreholes using an automated set-up or systems, for example employing robotic systems at the blast site. Furthermore, an automated set-up can be used to incorporate the detonator assemblies of the present invention into a blast array. Adaptation and use of the detonator assemblies, blasting apparatuses and methods for blasting of the present invention for use in automated establishment and execution of a blasting event lie within the scope of the present invention.

Figure 5:
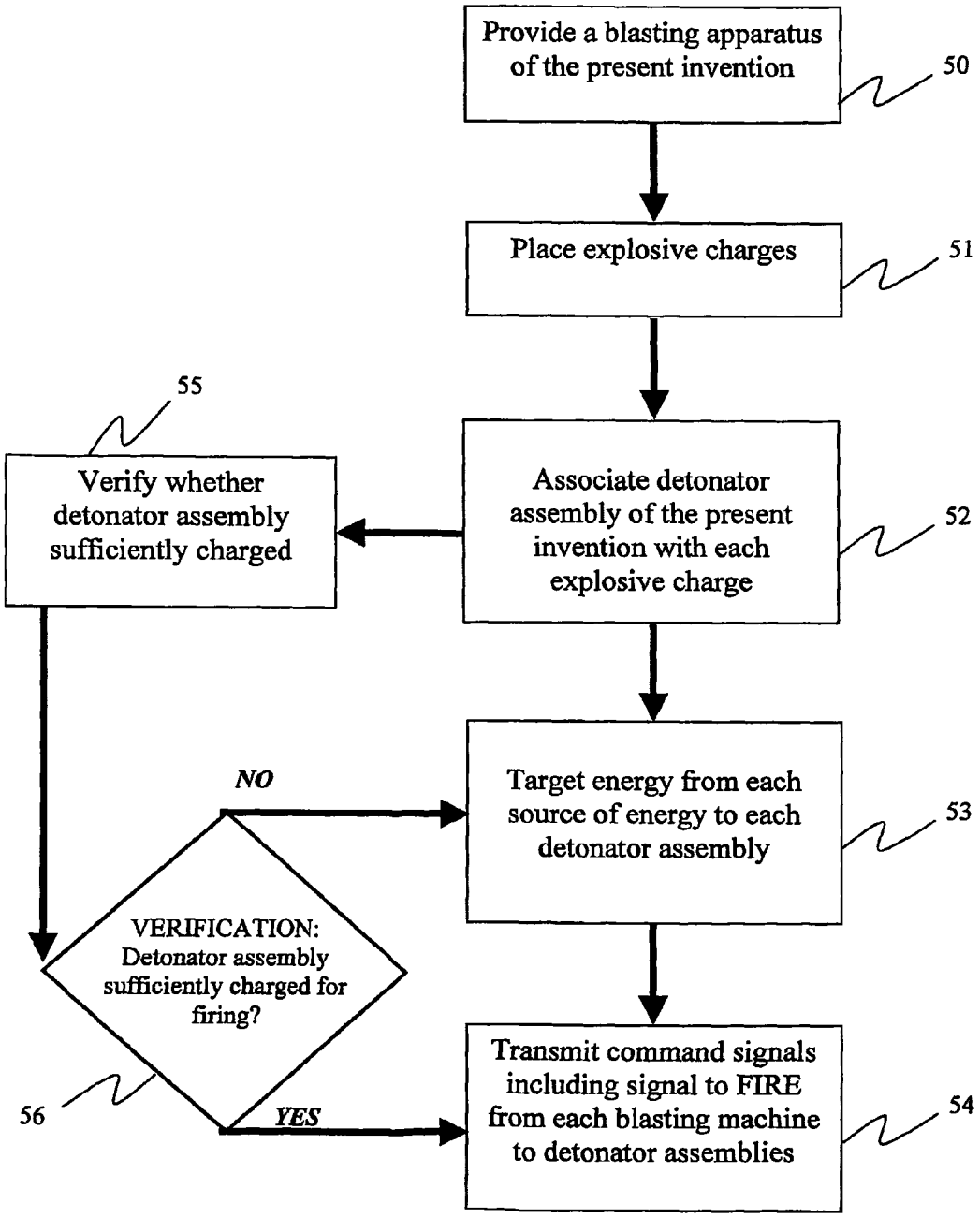
FIG. 5 is a flow chart diagram of one preferred embodiment of a method for blasting using a wireless detonator assembly, and blasting apparatus of the invention.

In another embodiment, the present invention provides for a method of blasting involving the detonator assemblies of the invention. The steps of the method are illustrated with reference to FIG. 5. In step 50 there is provided a blasting apparatus of the present invention. In step 51 the plurality of explosive charges are placed at the blast site, preferably in positions intended to affect a desired blasting pattern. In step 52 a detonator assembly of the present invention is associated with each explosive charge in a manner suitable for initiating the explosive charge upon actuation of the base charge of each detonator assembly. In step 53 energy of a desired form is targeted from each source of energy to each detonator assembly to cause each energy receiving means of each detonator assembly to receive energy to charge or power-up each detonator assembly, thereby to bring each detonator assembly into a suitable form for firing. In step 54, each blasting machine transmits at least one command signal, including for example a command signal to FIRE, to each detonator assembly, to cause each detonator assembly to discharge electrical energy stored therein into each firing circuit, thereby causing actuation of each base charge. Steps 53 and 54 may be conducted in any order. In preferred embodiments the command signals further comprise delay times and/or firing codes for each detonator assembly, thereby helping to effect a desired blasting pattern.

In still further embodiments, the methods of the invention may further involve verification steps 55, 56 to check whether or not the passive power source has sufficient stored power to activate the firing circuit upon release of the stored electrical power. In the absence of sufficient charge the method reverts to step 53 of targeting. In the presence of sufficient energy, the method continues to step 54 of base charge actuation upon receipt of a signal to FIRE.

Whilst the invention has been described with reference to specific embodiments of the detonator assemblies, blasting apparatuses, and methods of blasting of the present invention, a person of skill in the art would recognize that other detonator assemblies, blasting apparatuses, and methods of blasting that have not been specifically described would nonetheless lie within the spirit of the invention. It is intended to encompass all such embodiments within the scope of the appended claims. Moreover, in any of the embodiments illustrated and described herein, any reference to electromagnetic energy, light energy, microwave energy, radio signals, acoustic energy, electromagnetic induction energy, and other forms of wireless energy transfer are mentioned only by way of example. Any such types or forms of energy may be substituted by any other type or form of energy for either command signal communication or for 'powering-up' or 'charging' of a detonator assembly, to achieve the desired result of improvements in operation and safety.

The invention claimed is:,

1. A detonator assembly for use in connection with at least one blasting machine that transmits at least one wireless command signal via a first medium, the detonator assembly comprising:

a base charge;

a command signal receiving and processing means for wirelessly receiving and processing said at least one command signal from said at least one blasting machine;

an active power source to power said command signal receiving and processing means;

a power receiver for wirelessly receiving via a second medium power transmitted by a power emitter;

converting means for converting said power received from the power receiver to electrical power;

a passive power source in electrical connection with the converting means, the passive power source capable of storing said electrical power derived from said converting moans thereby to charge the detonator; and a firing circuit in connection with said base charge, for selectively receiving said electrical power stored in said passive power source, said active power source generating a power insufficient to activate said firing circuit and actuate said base charge, wherein receipt of a command signal to FIRE by said command signal receiving means causes release of said electrical power from said passive power source into said firing circuit thereby to actuate said base charge.

2. The detonator assembly of claim 1, wherein said at least one command signal comprises: radio waves, electromagnetic energy, acoustic energy, or involves electromagnetic induction.

3. The detonator assembly of claim 2, wherein the radio waves comprise VLF, ULF or ELF transmission.

4. The detonator assembly of claim 3, wherein the radiowaves have a frequency of from 100 to 2000 Hz.

5. The detonator assembly of claim 4, wherein the radio waves have a frequency of from 200 to 1200 Hz.

6. The detonator assembly of claim 1, wherein the power from the power emitter comprises: radio waves, electromagnetic energy, acoustic energy or involves electromagnetic induction.

7. The detonator assembly of claim 6, wherein the radio waves comprise VLF, ULF or ELF transmission.

8. The detonator assembly of claim 1, wherein the command signal receiving means and the power receiver comprises an electromagnetic energy receiving means, said command signal comprising electromagnetic energy of a first wavelength, said power emitted from said power emitter comprising electromagnetic energy of a second wavelength, said detonator assembly further comprising:

differentiating means in association with said electromagnetic energy receiving means for differentiating said electromagnetic energy of a first wavelength from said electromagnetic energy of a second wavelength, said electromagnetic energy of a first wavelength being received and processed by said command signal receiving and processing means, said electromagnetic energy of a second wavelength being converted by said converting means into said electrical power.

9. The detonator assembly of claim 8, wherein the electromagnetic energy of a first wavelength is received from a plurality of electromagnetic power emitters, each targeting the detonator assembly.

10. The detonator assembly of claim 8, wherein the electromagnetic energy of a second wavelength is received from a plurality of electromagnetic power emitters, each targeting the detonator assembly.

11. The detonator assembly of claim 8, wherein the differentiating means comprises one or more optical filters.

12. The detonator assembly of claim 8, wherein the electromagnetic energy of a first wavelength has a longer wavelength than the electromagnetic energy of a second wavelength.

13. The detonator assembly of claim 8, wherein the electromagnetic energy of a first wavelength is derived from at least one red laser.

14. The detonator assembly of claim 8, wherein the electromagnetic energy of a second wavelength is derived from at least one blue laser.

15. The detonator assembly of claim 1, wherein the command signal receiving and processing means comprises radio wave receiving means, said at least one command signal comprising radio wave transmission, and wherein said power receiver comprises electromagnetic energy receiving means, said emitted power comprising electromagnetic energy other than radio waves.

16. The detonator assembly of claim 1, wherein the command signal receiving and processing means comprises electromagnetic energy receiving means, at least one command signal comprising electromagnetic, energy, and wherein said power receiver comprises radio wave receiving means, said emitted power comprising radio waves.

17. The detonator assembly of claim 1, wherein the command receiving means comprises a first light energy receiving means, said command signals comprising light energy of a first wavelength, and wherein said power receiving comprises a second light energy receiving means, said emitted power comprising light energy of a second wavelength.

18. The detonator assembly of claim 17, wherein the light energy of a first wavelength is derived from at least one red laser, and the light energy of a second wavelength is derived from at least one blue laser.

19. The detonator assembly of claim 1, wherein said power receiver comprises an electromagnetic induction energy receiving means, said emitted power comprising electrical energy transmitted to said detonator assembly at least in part through electromagnetic induction.

20. The detonator assembly of claim 19, wherein the electromagnetic induction energy receiving means comprises at least one magnetic coupling device each in electromagnetic induction action relationship with at least one current-carrying conductive wire selectively carrying current from said power emitter.

21. The detonator assembly of claim 20, wherein each magnetic coupling device is a toroidal transformer, optionally comprising ferrite.

22. The detonator assembly of claim 21 wherein the light energy received by each light capture device is derived from a filament bulb, laser, laser diode, or LED.

23. The detonator assembly claim 22, wherein the light energy is derived from a laser.

24. The detonator assembly of claim 1, wherein command signal receiving means and/or the power receiver receives electromagnetic energy and comprises an electromagnetic energy receiving means.

25. The detonator assembly of claim 1, wherein said passive power source is selectee from the group consisting of: a capacitor, a diode, a rechargeable battery, fuel cell, an air cell such as a hearing aid battery, a micro-nuclear power source, and an activatable battery.

26. The detonator assembly of claim 1, further comprising a firing switch located between said passive power source and said firing circuit, said firing switch switching from an OFF position to an ON position upon receipt of a command signal to FIRE by said command signal receiving means, thereby establishing electrical connection between said passive power source and said firing circuit, to cause discharge of electrical power stored in said passive power source into said firing circuit, thereby to actuate said base charge.

27. The detonator assembly of claim 1. wherein the command signal receiving and processing means and/or the power receiver receives light energy and comprises a light capture device and optionally an optical cable for transferring light received by the light capture device to the converting means.

28. The detonator assembly of claim 27, wherein the light capture device can be positioned above ground to receive said light energy, said optical cable transferring said light energy into the ground to said converting means.

29. The detonator assembly of claim 1. wherein the converting means comprises a photovoltaic cell, a photodiode, or a phototransistor.

30. The detonator assembly of claim 1, wherein each command signal is selected from the group consisting of: ARM signals, DISARM signals, FIRE signals, detonator delay times, and detonator firing codes.

31. me detonator assembly of claim 1, further comprising signal transmission means for generating and transmitting at least one communication signal for receipt by said at least one blast machine.

32. The detonator assembly of claim 31, wherein each communication signal comprises detonator delay times, detonator firing codes, or detonator status information.

33. A blasting apparatus comprising:

at least one blasting machine capable of transmitting, command signals to associated detonators via wireless communications via a first medium;

at least one explosive charge;

at leas one detonator assembly of claim 1 associated with each explosive charge and in signal communication with said at least one blasting machine;

at least one power emitter for transmitting power via a second medium to each detonator assembly for receipt thereby in a suitable form to charge each detonator assembly for firing in response to a FIRE command signal from said at least one blasting machine; and optionally a central command station for controlling said at least one blasting machine.

34. The blasting apparatus of claim 33, wherein said at least one command signal comprises: radio signals, electromagnetic energy such as light energy, microwave energy, infrared, acoustic energy or involves electromagnetic induction.

35. The blasting apparatus of claim 33, wherein the emitted power comprises; radio signals, electromagnetic energy such as light energy, microwave energy, infrared, acoustic energy, or involves electromagnetic induction.

36. A method of blasting at a blast site, the method comprising the steps of;

providing a blasting apparatus of claim 33;

placing a plurality of explosive charges at the blast site;

associating each detonator assembly with an explosive charge such that actuation of each detonator assembly will cause actuation of each associated explosive charge;

targeting said power emitted from said power emitter to said at least one detonator assembly to cause each detonator assembly to receive said emitted power and convert said emitted power to electrical energy thereby to charge each detonator assembly for firing; and transmitting at least one command signal from said at least one blasting machine to cause each detonator assembly to discharge said electrical power into said firing circuit, thereby causing actuation of each base charge.

37. The method of claim 36, wherein said at least one command signal further comprises delay times for each detonator assembly, thereby to cause the detonator assemblies to fire in a specific timing pattern.

38. The method of claim 36, wherein each detonator assembly comprises a stored firing code, and said at least one command signal further comprise firing codes, each detonator assembly firing only if a stored firing code and a firing code from a command signal correspond.

39. The method of claim 36, wherein said at least one command signal and/or the emitted power comprises light energy.

40. The method of claim 36, further comprising the step of: verifying whether each detonator assembly is sufficiently charged to actuate the base charge, and if not then repeating at least the step of targeting.

41. Use of the blasting apparatus of claim 33, in a mining operation.

42. Use of claim 41, wherein the mining operation is an automated mining operation involving robotic placement and establishment of explosive charges and/or detonator assemblies at the blast site.

43. Use of the detonator assembly of claim 1, in a mining operation.

44. Use of claim 43, wherein the mining operation is an automated mining operation involving robotic placement and establishment of explosive charges and/or detonator assemblies at the blast site.

* * * * *